United States Patent [19]

Endo

[11] Patent Number: 4,786,584

[45] Date of Patent: Nov. 22, 1988

[54] METHOD OF SUPPLYING REPLENISHING SOLUTION IN AUTOMATIC DEVELOPING MACHINE

[75] Inventor: Yoichi Endo, Kanagawa, Japan

[73] Assignee: Fuji Photo Film Co., Ltd., Kanagawa, Japan

[21] Appl. No.: 67,182

[22] Filed: Jun. 29, 1987

[30] Foreign Application Priority Data

Jun. 27, 1986 [JP] Japan ..... 61-151214
Oct. 6, 1986 [JP] Japan ..... 61-237569

[51] Int. Cl.[4] ..... G03C 5/24; G03C 1/06

[52] U.S. Cl. ..... 430/434; 430/265; 430/268; 430/399

[58] Field of Search ..... 430/399, 434, 265, 268

[56] References Cited

U.S. PATENT DOCUMENTS

| | | | |
|---|---|---|---|
| 3,647,461 | 3/1972 | Surash et al. | 430/399 |
| 3,647,462 | 3/1972 | Surash et al. | 430/399 |
| 3,970,457 | 7/1976 | Parsonage | 430/399 |
| 4,081,280 | 3/1978 | Corluy et al. | 430/399 X |
| 4,228,234 | 10/1980 | Okutsu et al. | 430/399 |

FOREIGN PATENT DOCUMENTS

| | | |
|---|---|---|
| 1181624 | 1/1985 | Canada . |
| 2004893 | 8/1971 | Fed. Rep. of Germany . |
| 3635384 | 4/1987 | Fed. Rep. of Germany . |
| 2050828 | 3/1987 | Japan . |
| 2157839 | 10/1985 | United Kingdom . |

OTHER PUBLICATIONS

Research Disclosure #19620 pp. 331-332 Aug. 1980.
Research Disclosure #23809 pp. 38-40 Feb. 1984.

*Primary Examiner*—Mukund J. Shah
*Attorney, Agent, or Firm*—Sughrue, Mion, Zinn, Macpeak & Seas

[57] ABSTRACT

A method of supplying a replenishing solution to the processing tank incorporated in an automatic developing machine in which a photosensitive material is processed. In the method, a less active replenishing solution is first supplied to the processing tank at the commencement of the present processing operation of the automatic developing machine prior to our in the course of the processing of the photosensitive material, the less active replenishing solution compensating for the deterioration of a developer due to air during the preceding operating period and the subsequent stop period of the automatic developing machine. A normally active replenishing solution is then supplied to the processing tank after completion of the supply of the less active replenishing solution, the normally active replenishing solution compensating for the deterioration of the developer due to the processing of the photosensitive material. Accordingly, since these replenishing solutions are supplied in this manner, the photosensitive material can be stably developed.

14 Claims, 9 Drawing Sheets

(A)

(B)

METHOD OF SUPPLYING REPLENISHING SOLUTION IN AUTOMATIC DEVELOPING MACHINE

BACKGROUND OF THE INVENTION

1. Field of the Invention

The present invention relates generally to a method of supplying a replenishing solution in an automatic developing machine, and more particularly to a method of supplying a replenishing solution in an automatic developing machine in which the deterioration of a developer due to air is compensated for.

2. Description of the Prior Art

A lithographic developer, for example, may be used in obtaining high-contrast development of a photosensitive material. Typically, the lithographic developer contains only hydroquinone as a developing agent thereof. In order not to preclude or damage the capability of infectious development of the developer, sulfite as a preservative is used in the form of an addition product of formaldehyde therewith, and thus the concentration of free sulfurous acid ions is extremely reduced. Therefore, such a lithographic developer is remarkably susceptible to oxidization due to air, and has a material disadvantage in that it cannot possibly be preserved for greater than three days.

It is known that a hydrazine derivative is commonly employed in a method using a stable developer which is not susceptible to oxidization due to air. In accordance with the method, since highly concentrated sulfite may be added to a developer, the stability of the developer with respect to oxidization due to air is drastically improved. In the method using a hydrazine derivative, however, the pH of the developer is set to a value higher than the pH of a normal lithographic developer, so that the pH value tends to easily vary. This gives rise to a problem in that results derived from photographic characteristics are prone to vary due to the variations in the pH value.

On the other hand, attempts at stabilizing a developer have heretofore been made by improving a method of supplying the developer in an automatic developing machine. However, any proposal concerning an improvement in the supplying method is confined solely to the case of a lithographic developer. For this reason, any of the prior-art proposals gives consideration to deterioration factors such as aging fatigue (deterioration derived from oxidization) and processing fatigue (deterioration derived from development) in connection with a method of supplying the lithographic developer. However, no satisfactory proposal has been made with respect to a method in which silver halide photographic material containing a hydrazine derivative is processed and utilized in a stable state over an extended period of time by means of an automatic developing machine.

For instance, when using a high-contrast type developer including hydrazine by which a value of film is equal to or greater than 10, the activity of the developer in aqueous form is increased by its oxidization due to air. Thus, the sensitivity is increased and black spots on film are produced. To prevent this phenomenon, in the case of automatic development, the activity of a replenishing solution employed is typically adjusted to a lower level than that of a development initiating solution used therewith. However, as the quantity of a photosensitive material processed per unit time is increased, the quantity of a less-active replenishing solution to be supplied must be increased accordingly. This leads to the disadvantage that the thus-obtained activity of the solution is progressively decreased.

SUMMARY OF THE INVENTION

Object of the Invention

It is therefore an object of the present invention to provide a method of supplying a replenishing solution in an automatic developing machine in which, after the activity of the replenishing solution has been varied, such replenishing solution is supplied, thereby enabling stable processing of a photosensitive material.

This is achieved according to the present invention by a method of supplying a replenishing solution in an automatic developing machine, comprising the steps of: supplying a less active replenishing solution to the processing tank at the commencement of the present processing operation of the automatic developing machine prior to or in the course of the processing of the photosensitive material, the less active replenishing solution compensating for the deterioration of a developer due to air oxidation during the preceding operating period and the subsequent stop period of the automatic developing machine; and supplying a normally active replenishing solution to the processing tank after completion of the supply of the less active replenishing solution, the normally active replenishing solution compensating for the deterioration of the developer due to the processing of the photosensitive material.

In one specific form of the present invention, the value of the required quantity of the less active replenishing solution to be presently supplied (target MDR value) is obtained from the result of arithmetic operations based on the value of a predetermined quantity of the less active replenishing solution to be supplied (virtual MDR value) and the value of the quantity of the less active replenishing solution obtained from the operating and stop periods of the preceding supply (true MDR value).

As described above, the inventive method utilizes a less active type of replenishing solution for the purpose of correcting an increase in pH which might be caused by the deterioration of the developer due to its oxidization. Specifically, the level of any increase in pH caused by the deterioration due to oxidization greatly exceeds the level of any decrease in pH caused by development of film. Therefore, the less active replenishing solution is used to correct the increase in pH.

The less active replenishing solution used with the present invention is defined as a replenishing solution of the type which, when a silver halide photographic photosensitive material containing a hydrazine derivative is subjected to development under fixed conditions, the resultant photographic sensitivity is lower than that realized when development is effected using an initial developing solution. The photographic sensitivity mentioned above is represented by the reciprocal of an exposure value which provides a photographic density of 1.5. In this case, the fact that the photographic sensitivity is low mans that the value of the photographic sensitivity is equal to or less than 95%.

The less active replenishing solution used with the present invention may be freely selected from among various solutions less active than an initial developing solution employed. More specifically, the selection can be made from a solution of the type that shows a pH lower than that of the initial developing solution, a solution obtained by diluting the initial developing solution with water, a solution of the type in which the content of an organic antifoggant is greater than that of the initial developing solution, and a solution of the type in which the water content of a developing agent is less than that of the initial developing solution.

In this case, the difference in pH between the initial developing solution and the less active replenishing solution is preferably in the range of 0.05 to 0.2. If the initial developing solution is to be diluted with water, the ratio of the diluting water to the initial developing solution is preferably in the range of 0.05 to 0.2. Also, the difference in the content of the organic antifoggant is preferably in the range of 20 to 50%.

In order to realize a simple method of supplying a developer, it is particularly preferable to adopt a method in which an initial developing solution diluted with water is used for the less active replenishing solution.

In accordance with the present invention, the total quantity of the less active replenishing solution to be supplied per unit time is determined substantially in accordance with the length of the unit time. However, the total quantity is more or less varied in accordance with various potential factors such as the activity of the initial developing solution, the activity of the replenishing solution, the kind of an automatic developing machine, the quantity of the developer used and the kind of the photosensitive material. However, once these conditions required for development have been determined, it is possible to previously and easily determine the total quantity to be supplied which is suitable for such conditions. For instance, the total amount of the less active rplenishing solution to be supplied per unit time may be obtained in the following manner. At the commencement of development, the initial developing solution only is added to the developing bath of an automatic developing machine. Subsequently, after the automatic developing machine has been operated for an average operating period per day without supplying any replenishing solution to the bath, the machine is stopped. The next morning (that is, when twenty four hours have elapsed after the commencement of development), the operation of the automatic developing machine is again started. The total quantity of less active replenishing solution to be supplied per unit time (in this case, in one day) can be determined by calculating the quantity of the less active replenishing solution which is required so that the activity of the solution when the machine is again started may be maintained at the same level as the activity of the solution upon the commencement of the preceding development.

The thus-determined total quantity of less active replenishing solution is supplied by a variety of methods for a predetermined unit time. As an example, each time a photosensitive material is processed in a predetermined amount (corresponding to, for example, one sheet), a predetermined quantity of the replenishing solution may be supplied. If the quantity supplied for a predetermined period of time does not reach the aforesaid total quantity to be supplied, the resultant deficiency may be supplied at a give time during the predetermined period of time (for example, upon completion of a day's development work or prior to the commencement of the next day's development work).

Also, after the less active replenishing solution has been supplied in accordance with the quantity of the photosensitive material processed for a predetermined period of time, a predetermined quantity, that is, the total quantity to be supplied may be reached. In this case, subsequently, an active replenishing solution of the type which has substantially the same activity as that of the initial developing solution may be added in accordance with the quantity of the photosensitive material to be processed.

On the other hand, actual development conditions, such as the operating period, the stop period and the quantity of photosensitive material to be processed, are not always fixed. For this reason, it is preferable that the total quantity to be supplied is varied in accordance with variations in these conditions.

Here, the quantity required to be supplied so as to compensate for the maximum allowable variation relative to the sensitivity of the solution (i.e. the substantial photographic sensitivity of film varied with the activity of processing solution) under general development conditions is set as a virtual MDR value (minimum daily replenishment value) which is calculated based upon standard operational conditions such as a 9-hour operating period and a 15-hour stop period a day. On the basis of the virtual MDR value, the quantity which will presently be needed is set as a target MDR value.

The target MDR value varies in accordance with the past development conditions. More specifically, a true MDR value calculated from the preceding operating period and stop period differs from the preceding quantity of the less active replenishing solution which was actually supplied, so that an oversufficiency or a deficiency occurs in the quantity supplied.

For example, if the true MDR value is greater than that of the quantity of the less active replenishing solution which was actually supplied, the less active replenishing solution is insufficient by an amount equivalent to the resultant difference. The true MDR value is an amount to haven been replenished at the preceding processing which can be calculated based upon the actual operating period and stop period. If the deficiency exceeds the virtual MDR value, the resultant excess quantity is supplied immediately after commencement of the present development operation, thereby rendering the target MDR value equal to the virtual MDR value. The target MDR is an amount to be replenished at the present processing which is obtained by the preceding true MDR value and the preceding actual replenishing amount. (Refer to FIGS. 5(A) and 5(C).)

On the other hand, if the aforesaid deficiency does not exceed the virtual MDR value, variations in sensitivity are within an allowable range. Therefore, the present target MDR value is added in accordance with the resultant difference, thereby increasing the quantity of the less active replenishing solution which is expected to be presently supplied. (Refer to FIGS. 5(D) and 5(B).)

Moreover, if the true MDR value is less than the quantity of the less active replenishing solution which was actually supplied, the less active replenishing solution is excessive by an amount equivalent to the resultant difference. Therefore, the present target MDR value is decreased, thereby decreasing the quantity of the less active replenishing solution which is expected to be presently supplied. (Refer to FIGS. 5(E) and 5(F).)

In the manner described above, it is possible to change the quantity of the replenishing solution to be supplied in accordance with actual development conditions.

Further objects, features and advantages of the present invention will become apparent from the following description of preferred embodiments of the present invention with reference to the accompanying drawings.

DESCRIPTION OF THE PREFERRED EMBODIMENTS

Preferred embodiments of the present invention will be described below with reference to the accompany drawings.

First Embodiment

Figure 1:
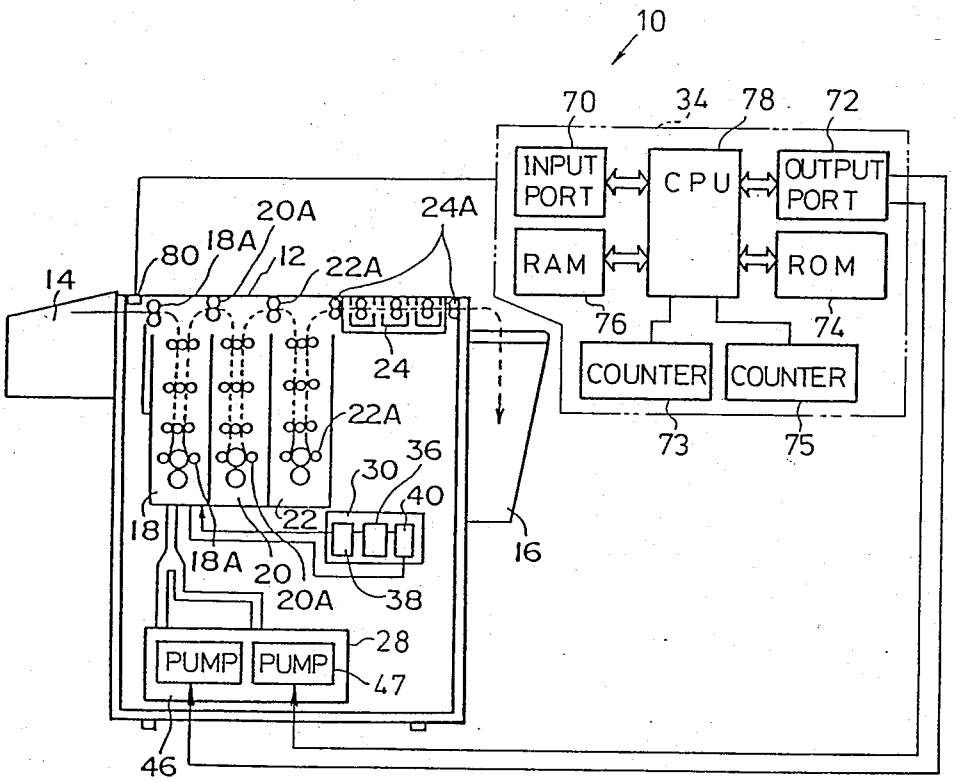
FIG. 1 is a diagrammatic illustration of an automatic developing machine to which a method of supplying a replenishing solution is applied in accordance with the present invention.

FIG. 1 diagrammatically shows an automatic developing machine to which a method of supplying a replenishing solution is applicable in accordance with the present invention.

An automatic developing machine constituting a first preferred embodiment is indicated generally at 10, and has the function of developing an unprocessed film, the function of fixing the thus-developed film, the function of washing the fixed film and the function of drying the washed film.

The automatic developing machine 10 includes a box 12 for shielding the aforesaid functions from external light. The box 12 has a film inserting table 14 at an upper portion of the front thereof, and unprocessed film inserted through the film inserting table 14. The box 12 further has a film stocker 16 at an upper portion of the rear thereof, and processed films are stocked in the film stocker 16. An opening through which an unprocessed film is inserted is formed in the portion of the box 12 on which the film inserting table 14 is mounted, and a sensor 80 for detecting the passage of the unprocessed film is disposed in the vicinity of the film inserting opening.

The sensor 80 is arranged in such a manner that light emitting elements and light receiving elements are disposed in face-to-face relationship with each other in the vicinity of the film inserting opening, the respective pairs of light emitting and receiving elements being provided throughout the width of an inserted film. When the inserted film passes by the light receiving elements, they are respectively turned on and off in accordance with the width of the inserted film, thereby outputting signals based on the width of the film. It is to be noted that the sensor 80 may be a sensor of the kind in which the light emitting elements cast light on the inserted film and thus the light receiving elements is turned on and off by receiving light reflected from the inserted film.

In the interior of the box 12, a developing tank 18, a fixing tank 20, a washing tank 22 and a drying section 24 are disposed in this order from the film inserting table 14 toward the film stocker 16. The box 12 further includes a solution supplying device 28, and a solution circulating device 30 and a control section 34.

The developing tank 18, the fixing tank 20, the washing tank 22 and the drying section 24 are disposed in the order of film processing, and include a plurality of guide rollers 18A, 20A, 22A and 24A, respectively, so as to convey the film to be processed therealong. The plurality of guide rollers 18A, 20A, 22A and 24A constitute in combination a passageway along which the film is conveyed by the rotation of these rollers.

Figure 2:
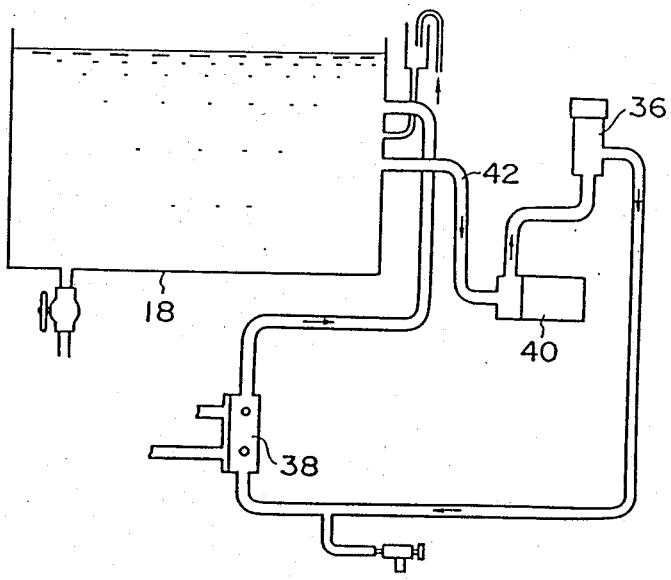
FIG. 2(A) is a diagram showing an example of the piping arrangement of a circulating device incorporated in the machine shown in FIG. 1.
FIG. 2(B) is a diagram showing an example of the piping arrangement of a solution suppling device incorporated in the machine shown in FIG. 1.
Figure 2:
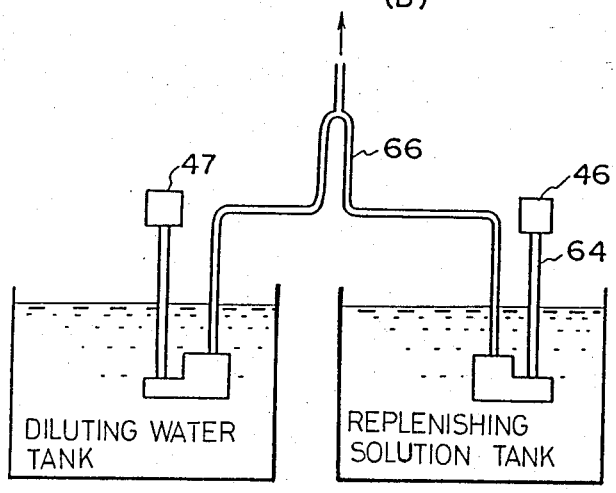

As shown in detail in FIG. 2(A), the solution circulating device 30 disposed in the interior of the box 12 includes a processing-solution filter 36, a heat exchanger 38 and a circulating pump 40. A pipe 42 provides communication between the developing tank 18 and the circulating pump 40, and the heat exchanger 38 provides communication between the processing-solution filter 36 and the developing tank 18.

Figure 3:
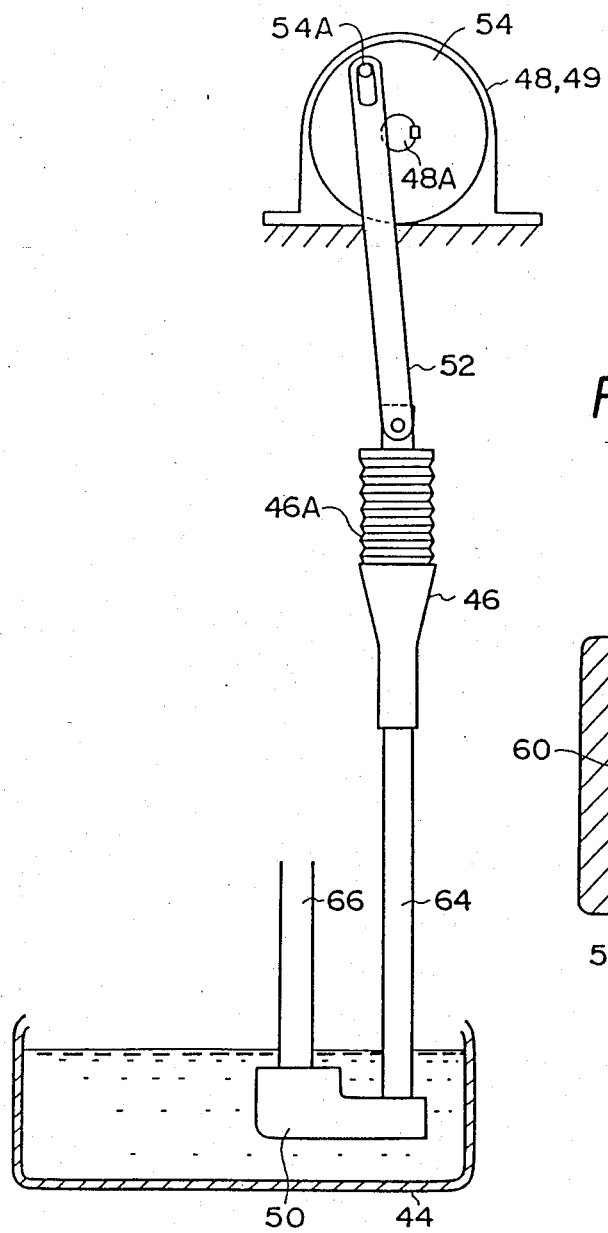
FIG. 3 illustrates the diagrammatic construction of a bellows pump incorporated in the machine shown in FIG. 1.

As shown in FIGS. 2(B) and 3, the solution supplying device 28 includes: a replenishing-solution tank 44 for storing therein a replenishing solution; a diluting-water tank 45 for storing therein diluting water used in diluting the replenishing solution; bellows pumps 46, 47; and motors 48, 49.

The bellows pump 46 is disposed so as to supply the replenishing solution from the replenishing-solution tank 44 and includes an expandable bellows 46A, a piping 64 and a replenishing-solution sucking portion 50. The bellows pumps 47 is also constructed in a similar manner. The bellows pumps 46 and 47 are disposed so as to supply the replenishing solution and the diluting water, respectively, to the developing tank 18. When the diluting water is to be supplied, a diluting-water sucking portion 51 serves to suck the water in place of the replenishing-solution sucking portion 50.

The bellows 46A is interlockingly connected at one end thereof to a corresponding end of a connecting rod 52 which constitutes a clank mechanism. The bellows 46A is further connected at the other end via the piping 46 to the replenishing-solution sucking portion 50 which is placed under the replenishing solution charged in the replenishing-solution tank 44. A motor 48 has an output shaft 48A, a rotary disc 54 being mounted on the output shaft 48A, and an eccentric shaft 54A being fixed at a position away from the center of the rotary disc 54. The connecting rod 52 is rotatably supported by the eccentric shaft 54A. The bellows pump 47 used in supplying the diluting water is also arranged in a manner similar to the bellows pump 46.

Figure 4:
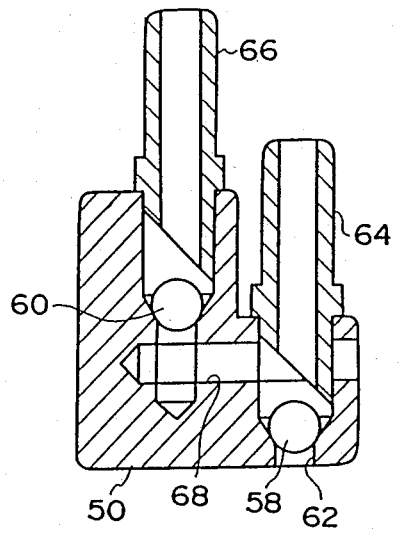
FIG. 4 is a diagrammatic view showing, in section, a developer sucking portion and a diluting-water sucking portion used with the bellows pump shown in FIG. 3.

Referring to FIG. 4, ball-shaped check valves 58 and 60 are accommodated in the replenishing-solution sucking portion 50 placed under the replenishing solution charged in the replenishing-solution tank 44. The check valve 58 is disposed so as to open and close an inlet 62 while the check valve 60 is disposed so as to open and close a flow channel 68 which provides communication between the piping 64 and a piping 66. Since the diluting-water tank 45 also has a similar construction, the detailed description is omitted for the sake of simplicity.

Referring back to FIG. 1, the control section 34 is constructed including a CPU 78, an input port 70, an output port 72, a ROM 74 and a RAM 76. Also, counters 75 and 74 are connected to the control section 34 so that measurement may be made with respect to the operating and stop periods of the automatic developing machine 10. The sensor 80 is connected to the input port 70 while the output port 72 is connected both to the pump 46 for supplying the replenishing solution and to the pump 47 for suppling the diluting water.

The following description refers to the operation of the first embodiment when an unprocessed film is processed.

After electric power has been supplied to the automatic developing machine 10, a film to be processed is inserted through the film inserting table 14. When the unprocessed film passes by the sensor 80, the sensor 80 detects the passage of the film and delivers the thus-detected signal to the input port 70 of the control section 34.

Subsequently, the unprocessed film is conveyed toward the bottom of the developing tank 18 along the film passageway which is formed by the plurality of guide rollers 18A disposed in the developing tank 18. The thus-conveyed film is reversed by the motion of the guide rollers 18A disposed at the bottom, and then is conveyed toward the top of the developing tank 18. The unprocessed film is passed through the developer stored in the tank 18. While the unprocessed film is being passed through the developing tank 18, it is developed. The thus-developed film is further conveyed into the fixing tank 20 along the film passageway which is formed by the plurality of guide rollers 20A arranged in the fixing tank 20, and is fixed therein. The film fixed in the fixing tank 20 is then conveyed toward the washing tank 22 along the film passageway which is formed by the plurality of guide rollers 22A arranged in the washing tank 22, and is washed therein. The washed film is guided by the plurality of guide rollers 24A toward the drying section 24, and, after being dried, it is accumulated in the film stocker 16.

The developer stored in the developing tank 18 is circulated by the circulating pump 40. During the circulation, the developer is cleaned through the processing-solution filter 36, and the temperature of the solution is adjusted by the heat exchanger 38 and is recirculated into the developing tank 18.

The replenishing solution is diluted with the diluting water, and is supplied to th developing tank 18. If the developer deteriorates due to development, the replenishing solution and the diluting water are supplied to the developing tank 18 so that the ratio of the former to the latter may be 1:1. Also, if the developer deteriorates due to its oxidization in air, the replenishing solution and the diluting water are supplied to the developing tank 18 so that the ratio of the former to the latter may be 4:5. As shown in FIG. 1, in the method of supplying both solutions, the replenishing solution discharged from the replenishing-solution tank 44 and the diluting water discharged from the diluting-water tank 45 are combined midway and supplied to the developing tank 18.

The operation of the bellows pump 46 and the motor 48 constituting the solution supplying device 28 will be described below with reference to FIGS. 3 and 4.

As described above, the bellows 46A is connected to one end of the connecting rod 52 constituting a clank mechanism. Rotation of the output shaft of the motor 48 causes linear movement of such end in the vertical direction, thereby expanding and contracting the bellows 46A. When the bellow 46A is contracted, the replenishing solution present in the pump 46 and the piping 64 acts on the check valve 58, thereby blocking the inlet 62. The operation acts on the replenishing solution present in the flow channel 68 and the check valve 60 is thereby pushed up in the vertical direction. As a consequence, the replenishing solution is discharged through the piping 66. Subsequently, when the bellows 46 is expanded, the check valve 58 is sucked and moved upward in the vertical direction, thereby causing the replenishing solution to flow into the flow channel 68 through the inlet 62. While the aforesaid expansion and contraction are being repeated, the thus-discharged replenishing solution is passed through the piping 66 and is supplied to the developing tank 18. Simultaneously, the diluting water is likewise discharged from the diluting-water tank 45 into the piping 66 by means of the bellows pump 47, mixed with the replenishing solution and then supplied to the developing tank 18.

Figure 6:
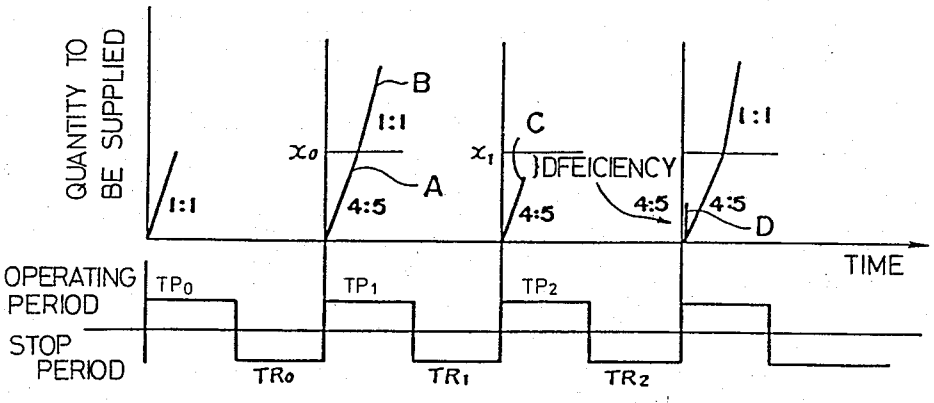
FIGS. 6 and 7 are graphs, respectively, used as an aid in explaining the relationship between the quantity to be supplied, the operating period of the automatic developing machine and the stop period of the same.

A method of supplying the replenishing solution by controlling the solution supplying device 38 will be described below with reference to the flow charts shown in FIGS. 6, 7 and 8.

Figure 8:
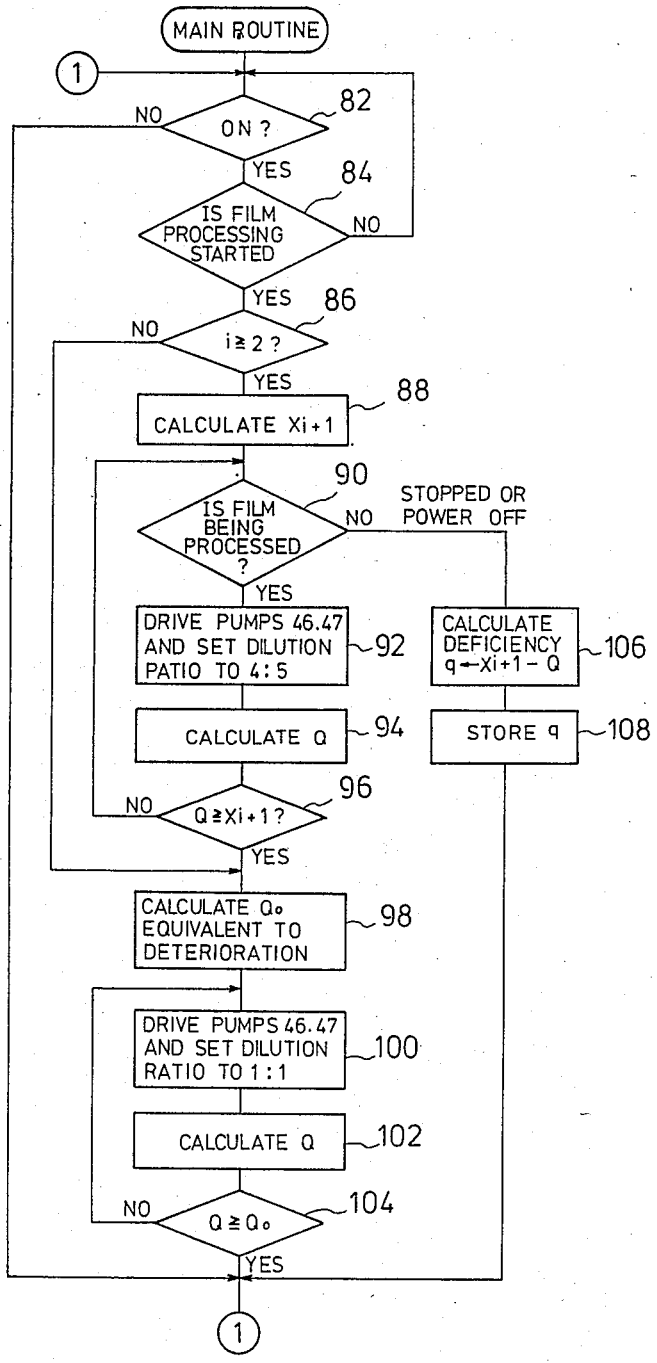
FIG. 8 is a flow chart of the main routine executed in a first embodiment of the present invention.

The following description concerns the main routine of FIG. 8 which is executed in the first embodiment.

In Step 82, judgement is made as to whether or not the automatic developing machine 10 is activated, that is, it is switched on. If the answer is "NO", the main routine is not executed. If the answer is "YES", the process proceeds to Step 84 in which judgement is made as to whether or not film processing is started. If the film processing has not yet started, the process returns to Step 82 and the aforementioned Step is repeated until the film processing is started. When the film processing is started, the process proceeds to Step 86, in which judgement is made as to the frequency of transition of the automatic developing machine 10 from the OFF state to the ON state. If a transition concerned is the second or following one, the process proceeds to Step 88, in which arithmetic operations are performed on a quantity $X_{i+1}$ to be supplied. The quantity $X_{i+1}$ to be supplied is obtained from the following equation:

$$X_{i+1}=(k_1\ TP_0+k_2\ TR_0)\ x\ldots \quad (1)$$

where $k_1$ and $k_2$ respectively represent the constants, x representing the quantity to be supplied when $TP_0$=nine hours and $TR_0$=fifteen hours, $TP_0$ representing the operating period of the automatic developing machine 10 and $TR_0$ representing the stop period of the same. The operating period $TP_0$ is calculated from an interrupt routine such as that shown in FIG. 9, the interrupt routine interrupting the main routine and being executed when the automatic developing machine 10 is set from "ON" to "OFF". The stop period $TR_0$ is calculated from an interrupt routine such as that shown in FIG. 10, the interrupt routine interrupting the main routine and being executed when the automatic developing machine 10 is set from "ON" to "OFF". The process proceeds to Step 90, in which judgement is made as to whether or not the film is being processed. If the answer is "YES", the process proceeds to Step 92, in which both the pump 46 for supplying the replenishing solution and the pump 47 for supplying the diluting water are driven to commence a new supply in accordance with the graph A shown in FIG. 6. At this point of time, the replenishing solution is diluted with the diluting water in the ratio of four to five, and thus the supply of less active replenishing solution is carried out. Following such supply, calculations are performed in Step 94 on a quantity Q of 4:5 diluted, less active replenishing solution which was supplied in Step 92. In Step 96, a comparison is made between the supplied quantity Q and the previously calculated quantity $X_{i+1}$ to be supplied, and the operations of from steps 90 to 96 are repeated until the calculated quantity $X_{i+1}$ is completely supplied. If it is judged in Step 86 that the transition is the first one, that is, it is neither the second nor subsequent one, the process jumps to Step 98, and Step 98 and the subsequent Steps are executed. When the supply of the calculated quantity $X_{i+1}$ is completed, calculations are performed on a quantity $Q_0$ to be supplied to compensate for the deterioration of the developer which is derived from the film processing. The process proceeds to Step 100, in which both the pump 46 for the replenishing solution and the pump 47 for the diluting water are driven to commence a new supply in accordance with the graph B shown in FIG. 6. At this point of time, the replenishing solution is diluted with the diluting water in the ratio of one to one. In Step 102, calculations are performed on the quantity Q of the 1:1 diluted, replenishing solution which was supplied. A comparison is made in Step 104 between the quantity Q supplied and the previously calculated quantity $Q_0$ to be supplied. The process from Step 100 to Step 104 is repeated until the calculated quantity $Q_0$ is completely supplied.

In Step 90, while the film is being processed, such processing may be stopped or the power supply of the automatic developing machine 10 may be turned off. In either of these cases, the process proceeds to Step 106, in which calculations are performed on a deficiency q which was not completely supplied. (Refer to the graph C shown in FIG. 6.) The deficiency q is stored in the RAM 76 in Step 108. This deficiency q is subsequently supplied by an interrupt routine which interrupts the main routine when the automatic developing machine 10 goes from the OFF state to the ON state.

The above-described main routine is repetitively executed when the automatic developing machine 10 is ON.

Figure 9:
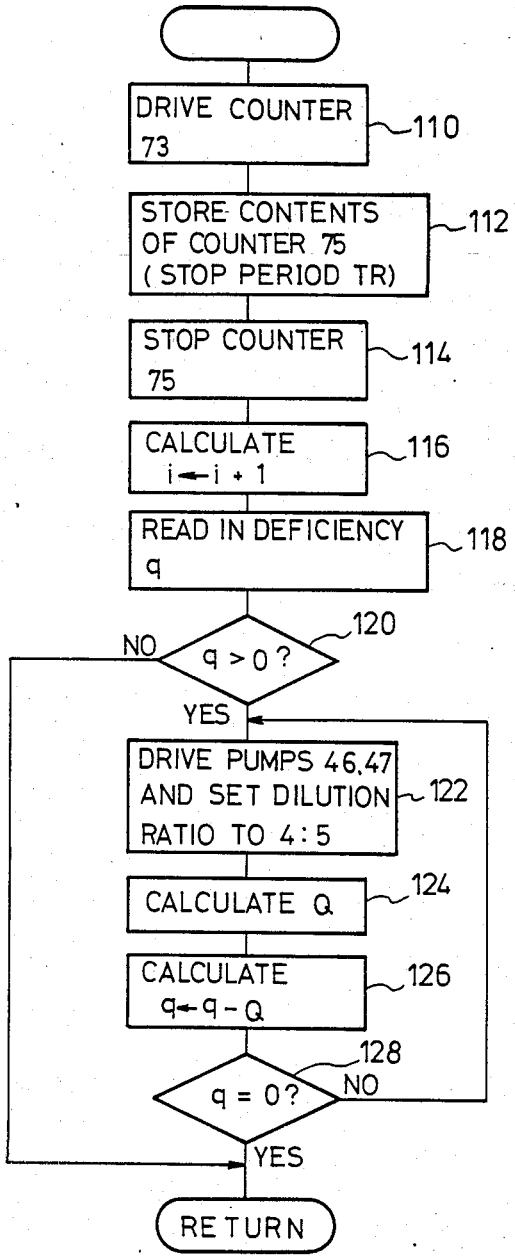
FIG. 9 is a flow chart of an interrupt routine executed in a first embodiment of the present invention.

The following is a description of an interrupt routine which interrupts the main routine shown in FIG. 9 when the automatic developing machine 10 goes from the OFF state to the ON state.

In Step 110, a counter 73 is driven to commence measurement of the operating period TP. The process proceeds to Step 112, in which storage of the contents of the counter 75, i.e., stop period TR is carried out. The counter 75 is adapted to be driven by the interrupt routine which interrupts the main routine and is executed when the automatic developing machine 10 goes from the OFF state to the ON state. The counter 75 is stopped in Step 114, and counts in Step 116 how many transitions from "OFF" to "ON" are carried out. The previously stored deficiency q during running of the main routine is read out in Step 118, and judgement is made in Step 120 as to whether the deficiency q is present or absent. If the deficiency q is present, the process proceeds to Step 122, in which the pumps 46 and 47 are driven to commence supply of the deficiency q. (Refer to the graph D shown in FIG. 6.) At this point of time, the replenishing solution is diluted with the diluting water in the ratio of four to five. The process proceeds to Step 124, in which calculations are performed on the quantity Q supplied. The quantity Q supplied is subtracted from the deficiency q in Step 126. Judgement is made in Step 128 as to whether or not the deficiency q reaches a zero level, that is, the supply of the deficiency q is completed. If the answer is "NO", the process returns to Step 122, and Steps 122 to 128 are repeatedly executed When the deficiency q is completely supplied, the process returns to the main routine and this routine is executed.

Figure 10:
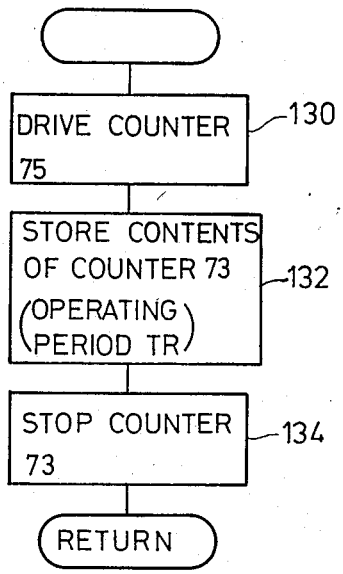
FIG. 10 is a flow chart of another interrupt routine executed in the first embodiment of the present invention.

The following is a description of the interrupt routine shown in FIG. 10, such interrupt routine being executed when the automatic developing machine 10 goes from the ON state to the OFF state.

In Step 130, the counter 75 is driven to commence measurement of the stop period TR. The contents of the counter 73, i.e., the operating period TP is stored in Step 132, the counter 73 being adapted to be driven by the interrupt routine which interrupts the main routine and is executed when the automatic developing machine 10 goes from the OFF state to the ON state. The counter 73 is stopped in Step 134.

Second Embodiment

The second embodiment will now be described below. The construction thereof is similar to that of the first embodiment. The second embodiment refers to a method of supplying the replenishing solution in a case where the operation period of the automatic developing machine 10 exceeds continuous twenty-four hours.

Figure 11:
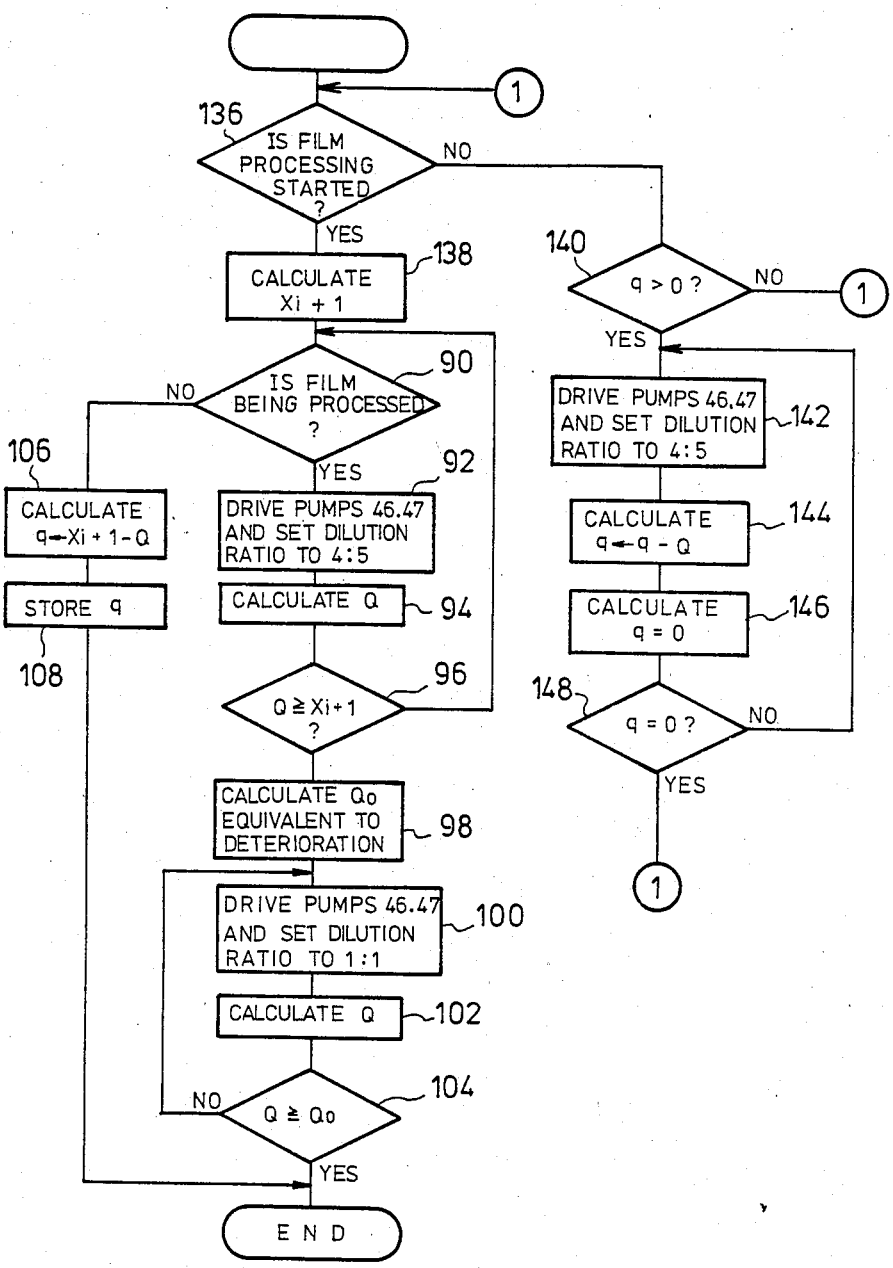
FIG. 11 is a flow chart showing the operations of a second embodiment of the present invention.

Referring to FIG. 11, there is shown a control routine illustrative of control exerted in a method of supplying the replenishing solution which is applied to the second embodiment. In Step 136, judgement is made as to whether or not film processing is commenced. If it is judged that the film processing is commenced, the process proceeds to Step 138 in which calculations are performed on the quantity $X_{i+1}$ to be supplied. Steps 138 and subsequent Steps are the same as Steps 90 to 108 described previously in the first embodiment. Therefore, like reference numerals are used to denote the like or corresponding Steps in the first embodiment, and the description is omitted for the sake of simplicity.

Figure 7:
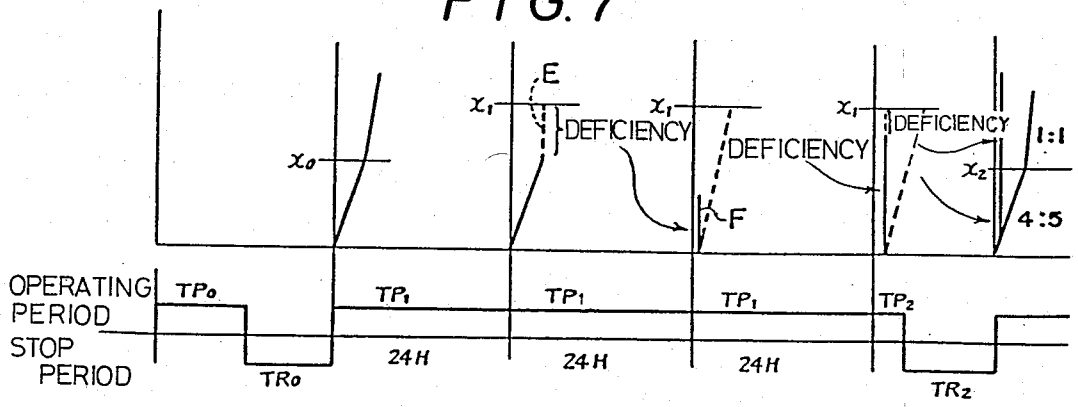

If it is judged in Step 136 that no film processing is commenced, the process proceeds to Step 140 in which judgement is made as to the presence or absence of the deficiency q to be supplied If it is judged that the deficiency q is present (refer to the graph E of FIG. 7), the process proceeds to Step 142 in which the pumps 46 and 47 are driven to commence to supply the deficiency q in accordance with the graph F shown in FIG. 7. The quantity Q thus supplied is calculated in Step 144, and in Step 146 the quantity Q supplied is subtracted from the deficiency q. In Step 148, judgement is made as to whether the deficiency q reaches a zero level, that is, the deficiency q is completely supplied. If the answer is "NO", the process returns to Step 142, and Steps 142 to 148 are repeatedly executed. When the supply of the deficiency q has been completed, the process returns ahead of Step 136, in which judgement is made as to whether or not film processing is resumed.

Third Embodiment

Figure 5:
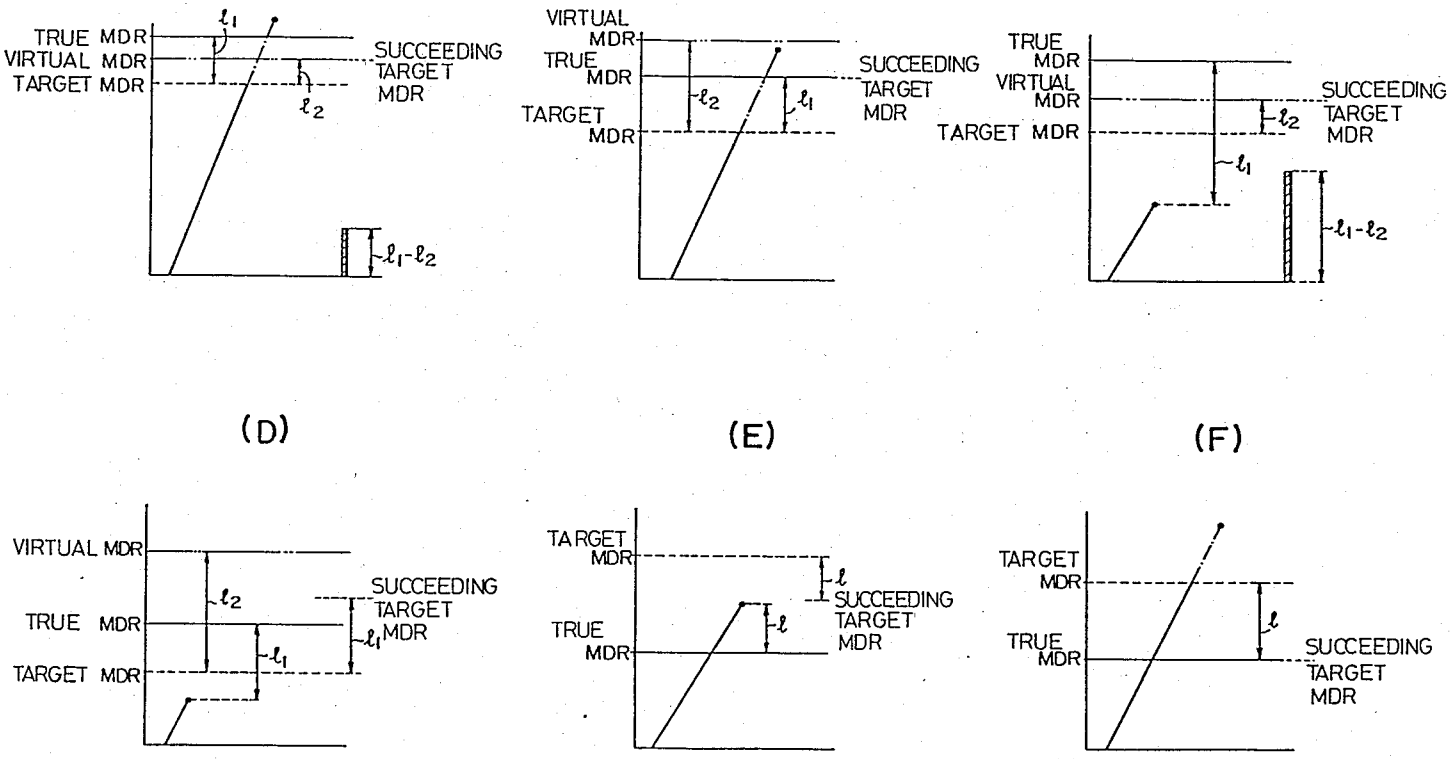
FIGS. 5(A) through 5(F) are graphs, respectively, used as an aid in explaining the relationship between the quantity to be supplied, the operating period of the automatic developing machine and the stop period of the same.

The following is a description of the third embodiment. The construction of this embodiment is similar to those of the first and second embodiments. In the description of the third embodiment, the case of altering the total amount to be supplied will be mentioned with reference to the timing chart of FIG. 5 and the flow chart shown in FIG. 12.

Figure 12:
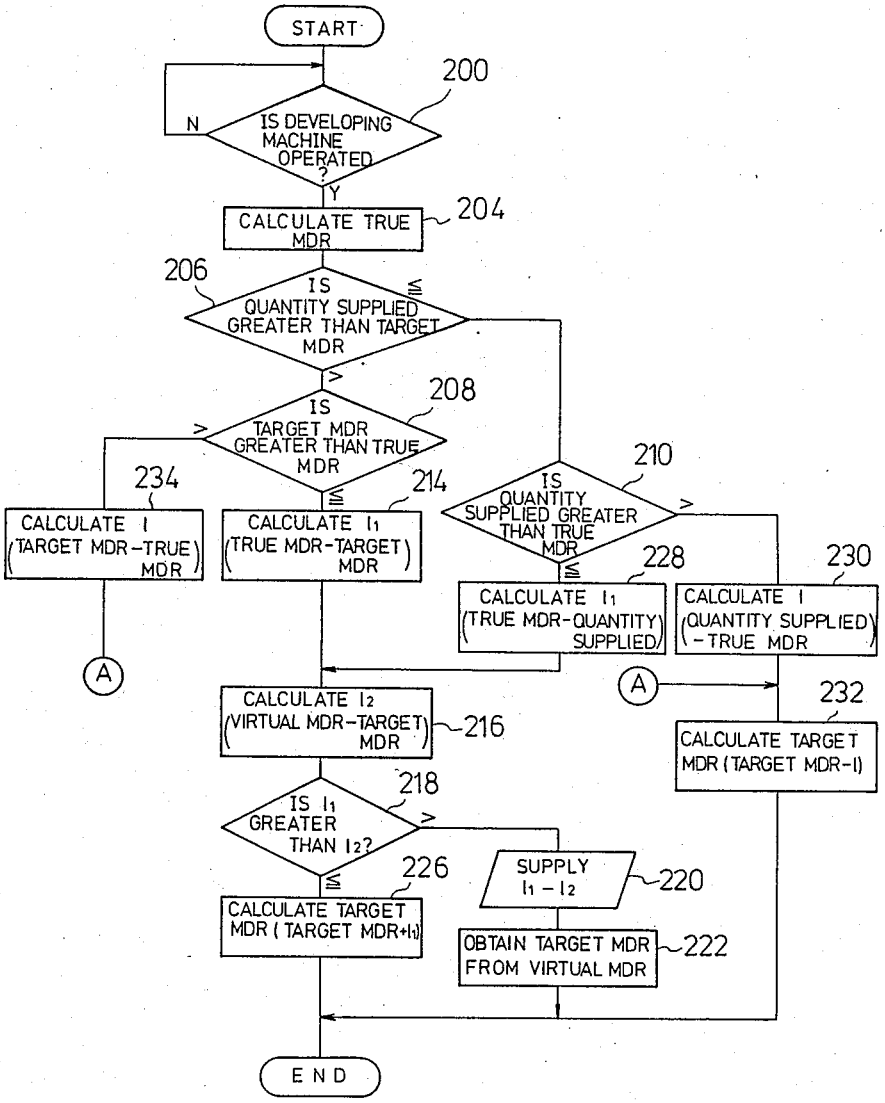
FIG. 12 is a flow chart showing the operations of a third embodiment of the present invention.

Referring to FIG. 12, there is shown a control routine depicting control exerted in a method of supplying the replenishing solution which is applied t the third embodiment.

In Step 200, judgement is made as to whether or not the automatic developing machine 10 is in operation. If the answer is "NO", such judgement is repeated. If the answer is "YES", the process proceeds to Step 204.

Calculations are performed in Step 204 on the preceding true MDR value. Subsequently, in Step 206, a comparison is made between the preceding quantity which was actually supplied and the preceding target quantity to be supplied. In other words, judgement is made as to whether the preceding processing handled a large or small quantity of film. If the actually supplied quantity is greater than the target quantity to be supplied, it is judged that the preceding processing handled a large quantity of film. Thus, the process proceeds to Step 208. On the other hand, if it is judged that the former quantity is less than the latter quantity, the process proceeds to Step 210.

In Step 208, a comparison is made between the target MDR value and the true MDR value. If the true MDR value is greater than the target MDR value, it is judged that a long period of time has elapsed after completion of the preceding processing. Thus, calculations are performed in Step 214 on a difference l1 between the true MDR value and the target MDR value, and in Step 216 calculations are performed on a difference l2 between the virtual MDR value and the target MDR value.

Subsequently, the differences l1 and l2 are compared in Step 218. If $l1>l2$, the quantity supplied is greater than the difference l2 between the virtual MDR value and the target MDR value. Thus, the process proceeds to Step 220 in which the replenishing solution is supplied in an amount equivalent to the resultant difference $(l1-l2)$. The process proceeds to Step 222, in which the target MDR value is set to the virtual MDR value to obtain the succeeding target MDR value. (Refer to the graph A of FIG. 5.)

Also, if it is judged in Step 218 that $l1 \leqq l2$, the quantity is less than the difference l2 between the virtual MDR value and the target MDR value. Therefore, since it is judged that no supply is needed, the process proceeds to Step 26. In Step 226, the aforesaid difference l1 is added to the target MDR value to obtain the succeeding target MDR value. Accordingly, in this case, no supply of the replenishing solution is carried out. (Refer to the graph B of FIG. 5.)

If it is judged in Step 206 that the target MDR value is equal to or greater than the actually supplied quantity, that is, the preceding processing handled a small quantity of film, the process proceeds to Step 210. The actually supplied quantity is compared with the true quantity to be supplied. If the true quantity is equal to or greater than the MDR value, the process proceeds to Step 228. After calculations have been performed on the difference l1 between the true MDR value and the quantity supplied, the process proceeds to Step 216. Subsequently, the process proceeds to Steps 218, 220 and 222 in this order. (Refer to the graph C of FIG. 5.) Alternatively, the process proceeds from Step 218 to Step 226. (Refer to the graph D of FIG. 5.)

On the other hand, if it is judged in Step 210 that the actually supplied quantity is greater than the true MDR value, a short period of time has elapsed after the preceding processing has been completed. Thus, the process proceeds to Step 230, in which calculations are performed on the difference l between the actually supplied quantity and the true MDR value. Subsequently, in Step 232, this l is subtracted from the target MDR value to obtain the succeeding target MDR value. In this case as well, no supply of the replenishing solution is carried out. (Refer to the graph E of FIG. 5.)

In Step 208, if the target MDR value is greater than the true MDR value, it is judged that a short period of time has elapsed after completion of the processing of a large quantity of film. Thus, the process proceeds to Step 234. After the difference l1 between the target MDR value and the true MDR value has been calculated in Step 234, the process proceeds to Step 232. (Refer to the graph F of FIG. 5.)

As described above, judgement is made as to whether or not the less active replenishing solution should be supplied in accordance with variations with time in the pattern of the preceding film processing. The quantity to be supplied is also calculated on the basis of the variations with time. Accordingly, there is no great difference in developing capability between the commencement of processing of the photosensitive material and the termination thereof

What is claimed is:

1. A method of supplying a replenishing solution to the processing tank incorporated in an automatic developing machine in which a photosensitive material is subject to developement by means of a developer, said developer having a desired pH, comprising the steps of:

supplying a less active replenishing solution to said processing tank at the commencement of the present processing operation of said automatic developing machine prior to or in the course of the processing of said photosensitive material, said less active replenishing solution compensating for the deterioration of a developer due to air oxidation during the preceding operating period and the subsequent stop period of said automatic developing machine, wherein said less active replenishing solution has a lower pH than said desired pH of said developer; and supplying a normally active replenishing solution to said processing tank after completion of the supply of said less active replenishing solution, said normally active replenishing solution compensating for the deterioration of said developer due to the processing of said photosensitive material, said normally active replenishing solution having the same pH as said desired pH of said developer, wherein the value of the required quantity of said less active replenishing solution to be presently supplied represents a target MDR value, said target MDR value being obtained from the result of arithmetic operations based on a virtual MDR value of a predetermined quantity of said less active replenishing solution to be supplied under standard operational conditions and a true MDR value of the calculated quantity of said less active replenishing solution to be supplied, said true MDR value being obtained from the operating and stop periods of the preceding replenishment.

2. A method of supplying a replenishing solution according to claim 1, wherein, if the processing of said photosensitive material is completed prior to the completion of supply of said less active replenishing solution, said less active replenishing solution is supplied upon commencement of the succeeding processing operation of said automatic developing machine.

3. A method of supplying a replenishing solution according to claim 1, wherein, if said present operating period continuously exceeds a predetermined period of time, said less active replenishing solution is supplied when said predetermined period is exceeded.

4. A method of supplying a replenishing solution according to claim 1, wherein said replenishing solution is prepared by mixing a developer and diluting water, said less active replenishing solution differing from said normally active replenishing solution in respect of the mixture ratio of said developer and said diluting water.

5. A method of supplying a replenishing solution according to claim 4, wherein, if said true MDR value is greater than the quantity actually supplied during the preceding processing operation and the resultant difference exceeds said virtual MDR value, said target MDR value is increased by an amount equivalent to such excess, said replenishing solution being thus supplied by an amount equivalent to such increment immediately after the commencement of the present processing operation.

6. A method of supplying a replenishing solution according to claim 4, wherein, if said true MDR value is greater than the value of said quantity actually supplied during the preceding processing operation and the resultant difference does not exceed said virtual MDR value, said target MDR value is increased by an amount equivalent to said difference.

7. A method of supplying a replenishing solution according to claim 6, wherein, if said true MDR value is less than the preceding quantity actually supplied, said target MDR value is decreased by an amount equivalent to the difference between the former and the latter values.

8. A method of supplying a replenishing solution to the processing tank of an automatic developing machine in which a photosensitive material is subjected to development by means of a developer, said developer having a desired pH, comprising the steps of:

obtaining the required quantity of a less active replenishing solution to be presently supplied so as to compensate for the deterioration of said developer due to air oxidation in the course of the preceding operating period of said automatic developing machine and the succeeding stop period of the same, said less active replenishing solution having a pH lower than said desired pH of said developer; and supplying said required quantity to said processing tank prior to or in the course of the development of said photosensitive material at the commencement of the present processing operation of said automatic developing machine, wherein a target MDR value of said required quantity is obtained from the result of calculations performed on the basis of a virtual MDR value of a predetermined quantity of said less active replenishing solution to be supplied under standard operational conditions and a true MDR value of the calculated quantity of said less active replenishing solution to be supplied, said true MDR value being obtained on the basis of the preceding operating period and the subsequent stop period.

9. A method of supplying a replenishing solution according to claim 8 further comprising the step of supplying a normally active replenishing solution to said processing tank after completion of the supply of said required quantity, said normally active replenishing solution compensating for the deterioration of said developer due to development.

10. A method of supplying a replenishing solution according to claim 8, wherein, if the development of said photosensitive material is completed prior to completion of the supply of said required quantity of said less active replenishing solution, said less active replenishing solution is supplied at the commencement of the succeeding processing operation of said automatic developing machine.

11. A method of supplying a replenishing solution according to claim 10, wherein, if said true MDR value is greater than the value of the preceding quantity of said less active replenishing solution actually supplied and the resultant difference exceeds said virtual MDR value, said target MDR value is increased by an amount equivalent to said difference.

12. A metood of supplying a replenishing solution according to claim 11, wherein, if said true MDR value is greater than the value of the preceding quantity of said less active replenishing solution actually supplied and the resultant difference exceeds said virtual MDR value, said target MDR value is increased by an amount equivalent to the difference between the former and latter values.

13. A method of supplying a replenishing solution according to claim 12, wherein, if said true MDR value is less than the value of the preceding quantity of said less active replenishing solution actually supplied, said target MDR value is decreased by an amount equivalent to the resultant difference between the former and latter values.

14. A method of supplying a replenishing solution according to claim 9, wherein said replenishing solution is prepared by mixing said developer and diluting water, said less active replenishing solution and said normally active replenishing solution differing from each other in respect of the mixture ratio of said developer and said diluting water.

* * * * *